US009054470B2

(12) United States Patent
YuQiang et al.

(10) Patent No.: US 9,054,470 B2
(45) Date of Patent: Jun. 9, 2015

(54) ELECTRICAL CONNECTOR HAVING AN ELECTRICAL CONTACT WITH A PLURALITY OF CONTACT BEAMS

(71) Applicants: Tyco Electronics Corporation, Berwyn, PA (US); Tyco Electronics (Shanghai) Co., Ltd., Shanghai (CN)

(72) Inventors: Zhao YuQiang, Shanghai (CN); Robert Paul Nichols, Vacaville, CA (US); Zhao Guangming, Shanghai (CN); Michael Allen Blanchfield, Camp Hill, PA (US)

(73) Assignees: Tyco Electronics Corporation, Berwyn, PA (US); Tyco Electronics (Shanghai) Co., Ltd., Shanghai (CN)

( * ) Notice: Subject to any disclaimer, the term of this patent is extended or adjusted under 35 U.S.C. 154(b) by 77 days.

(21) Appl. No.: 13/922,720

(22) Filed: Jun. 20, 2013

(65) Prior Publication Data

US 2014/0295680 A1 Oct. 2, 2014

(51) Int. Cl.

| | |
|---|---|
| ***H01R 4/48*** | (2006.01) |
| ***H01R 27/02*** | (2006.01) |
| ***H01R 12/72*** | (2011.01) |

(52) U.S. Cl.

CPC ..... *H01R 27/02* (2013.01); *H01R 12/724* (2013.01)

(58) Field of Classification Search

CPC ..... H01R 13/2442
USPC ..... 439/862, 947, 857
See application file for complete search history.

(56) References Cited

U.S. PATENT DOCUMENTS

| | | | | |
|---|---|---|---|---|
| 4,734,041 | A * | 3/1988 | Bruchmann et al. | 439/637 |
| 6,471,523 | B1 * | 10/2002 | Shuey | 439/63 |
| 6,565,392 | B2 | 5/2003 | Padro | |
| 6,645,012 | B2 * | 11/2003 | Ito et al. | 439/637 |
| 6,776,635 | B2 * | 8/2004 | Blanchfield et al. | 439/181 |
| 6,890,214 | B2 | 5/2005 | Brown et al. | |
| 7,065,871 | B2 | 6/2006 | Minich et al. | |
| 7,186,121 | B1 | 3/2007 | Costello et al. | |
| 7,476,108 | B2 * | 1/2009 | Swain et al. | 439/79 |
| 7,527,533 | B2 | 5/2009 | Lappoehn | |
| 7,780,483 | B1 | 8/2010 | Ravlich | |
| 7,997,938 | B2 | 8/2011 | Costello et al. | |
| 8,002,559 | B2 | 8/2011 | Thiel et al. | |

OTHER PUBLICATIONS 1469921-1 MiniPak HD Power-Signal Connector (Sep. 2008).
EXTreme Ten60Power Hybrid Power and Signal Connectors (2011).
Minipak High-Density Board-to-Board Power Connectors, Tyco Electronics (2010).

(Continued)

*Primary Examiner* — Phuong Dinh

(57) ABSTRACT

Electrical connector including a connector housing having a mating side that faces in a mating direction. The mating side configured to engage a mating connector. The electrical connector also includes an electrical contact held by the connector housing. The electrical contact includes a common body section and first, second, and third contact beams that are arranged along the mating side and have respective contact bases coupled to the body section. Each of the first, second, and third contact beams extend in the mating direction from the respective contact base to a respective distal end. Each of the first, second, and third contact beams has a beam length that is measured from the respective contact base to the respective distal end. The beam lengths of the first, second, and third contact beams being different from one another.

14 Claims, 7 Drawing Sheets

(56) References Cited

OTHER PUBLICATIONS

Molex Extreme Power Products Catalog (downloaded Feb. 6, 2013).
Molex Power Connectors Catalog (partial) (downloaded Feb. 6, 2013).
Multi-Beam XL and Multi-Beam XLE Power Distribution Connector Systems (2010).
Multi-Beam XL Connectors (Apr. 6, 2011).
Product Specification for Ten60Power Board to Board Interconnect Systems (Aug. 2011).
SD-46436-1080 Molex Ten60 Power Receptacle (Jul. 2009).
SD-46562-1171 Molex Ten60 Vertical Receptacle (Nov. 2010).
Solutions for AdvancedTCA, AdvancedTCA 300, MicroTCA, and AdvancedMC Standards, Tyco Electronics (2007).

* cited by examiner

ELECTRICAL CONNECTOR HAVING AN ELECTRICAL CONTACT WITH A PLURALITY OF CONTACT BEAMS

CROSS-REFERENCE TO RELATED APPLICATION

The present application claims the benefit of Chinese Patent Application No. 201310111077.1, filed on Apr. 1, 2013, which is incorporated herein by reference in its entirety.

BACKGROUND

The subject matter herein relates generally to an electrical connector that has at least one electrical contact with a plurality of contact beams that engage corresponding contacts of another connector during a mating operation.

Electrical connectors provide communicative interfaces between electrical components where power and/or signals may be transmitted therethrough. Electrical connectors may be used within telecommunication equipment, servers, and data storage or transport devices. For example, in some communication systems, an electrical connector is mounted along a leading edge of a circuit board to form a circuit board assembly. The electrical connector typically includes a plurality of electrical contacts that are capable of transmitting electrical power or data signals from and/or to the circuit board. The electrical connector includes a mating side that faces away from the leading edge and has the electrical contacts arranged therealong. During a mating operation, the electrical contacts engage corresponding contacts of another connector (hereinafter referred to as the mating connector). The mating side may be advanced in an insertion direction toward the mating connector. As the electrical connector and the mating connector begin to mate with each other, the contacts of the electrical connector directly engage the corresponding contacts.

The engagement between two individual contacts typically involves friction and deflection forces that impede movement of the electrical connector in the mating direction. Although the friction and deflection forces that must be overcome when a single contact engages another single contact are typically small, the sum of these forces when many contacts simultaneously engage each other can be quite large and may require application of a substantial mating force to overcome the sum of the friction and deflection forces. Mating operations that require large instantaneous mating forces are generally undesirable because large mating forces result in difficulty in mating the two connectors and increase the likelihood of damaging the contacts of at least one of the connectors.

Typically, electrical connectors are used in environments, such as in offices or homes, where the connectors are not subjected to constant shock, vibration, and/or extreme temperatures. However, in some applications, such as aerospace or military equipment, the electrical connector should be configured to withstand certain conditions and still effectively transmit power and/or data signals. In fact, customers may require that the connectors be able to sustain large amounts of shock even for applications where the environment is typically free from significant vibrations. For example, customers may require that electrical connectors used in isolated server rooms be able to sustain large shocks on rare occasions, such as during an earthquake. However, many electrical connectors have limited capabilities for sustaining shock and vibrations.

Accordingly, there is a need for an electrical connector that is capable of transmitting electric current in a range of environments and has a relatively low mating force requirement.

BRIEF DESCRIPTION

In one embodiment, an electrical connector is provided that includes a connector housing having a mating side that faces in a mating direction. The mating side configured to engage a mating connector. The electrical connector also includes an electrical contact held by the connector housing. The electrical contact includes a common body section and first, second, and third contact beams that are arranged along the mating side and have respective contact bases coupled to the body section. Each of the first, second, and third contact beams extend in the mating direction from the respective contact base to a respective distal end. Each of the first, second, and third contact beams has a beam length that is measured from the respective contact base to the respective distal end. The beam lengths of the first, second, and third contact beams being different from one another.

Each of the first, second, and third contact beams may be shaped to form a mating interface proximate to the distal end that directly engages the mating connector. The first, second, and third contact beams may have first, second, and third mating lengths, respectively, that are measured from the respective contact base to the respective mating interface. The first, second, and third mating lengths can be different from one another. In some cases, one or more of the contact beams is capable of independently flexing about the respective contact base.

The first, second, and third contact beams and the body section may be substantially aligned along a common contact plane that extends along the mating direction. The body section may be substantially planar. The connector housing may include a mounting side that is configured to engage a circuit board. The planar body section can be orthogonal to the circuit board when electrical connector is mounted thereto.

In some embodiments, the electrical connector includes first and second electrical contacts that have similar features. The first electrical contact may be the electrical contact described above. The second electrical contact may include a respective common body section coupled to fourth and fifth contact beams. Each of the fourth and fifth contact beams may extend in the mating direction from a respective contact base that is coupled to the body section to a respective distal end. The fourth and fifth contact beams may have fourth and fifth beam lengths, respectively, that are measured from the respective contact base to the respective distal end. The fourth and fifth beam lengths can be different from each other. In some embodiments, the body sections of the first and second electrical contacts are substantially planar and either extend parallel to each other or are aligned along a common contact plane.

In certain embodiments, the distal ends of the first, second, and third contact beams have different axial locations with respect to an engagement axis that extends along the mating direction. In various embodiments, the first contact beam may be adjacent to the second contact beam and the third contact beam may be adjacent to at least one of the first contact beam or the third contact beam. Also, the electrical contact may include a plurality of at least one of the first contact beam, the second contact beam, or the third contact beam. For example, there may be two first contact beams, two second contact beams, and two third contact beams.

In another embodiment, an electrical connector is provided that includes a connector housing having a mating side that faces in a mating direction along an engagement axis. The mating side is configured to engage a mating connector. The electrical connector may also include an electrical contact held by the connector housing. The electrical contact may include a common body section and first, second, and third contact beams that are arranged along the mating side and configured to engage the mating connector. Each of the first, second, and third contact beams extends parallel to the engagement axis from a respective contact base that is coupled to the body section to a respective distal end. The distal ends of the first, second, and third contact beams have different axial locations with respect to the engagement axis.

In some cases, the first, second, and third contact beams may have first, second, and third beam lengths, respectively, that are measured from the respective contact base to the respective distal end. The first, second, and third beam lengths may be different from one another.

In another embodiment, an electrical connector is provided that includes a connector housing having a mating side that faces in a mating direction. The mating side is configured to engage a mating connector. The electrical connector also includes separate first and second electrical contacts held by the connector housing. Each of the first and second electrical contacts includes a common body section and a plurality of contact beams that are positioned along the mating side and configured to engage the mating connector. Each of the contact beams of said plurality extends in the mating direction along an engagement axis from a respective contact base that is coupled to the body section to a respective distal end. The distal ends have corresponding axial locations with respect to the engagement axis, wherein the contact beams of said plurality have at least one of (a) different beam lengths measured from the respective contact base to the respective distal end or (b) different axial locations of the distal ends. The first and second electrical contacts are substantially aligned such that the body sections and the contact beams of the first and second electrical contacts are substantially aligned along a common contact plane that extends along the mating direction.

In some embodiments, the contact beams of the first electrical contact include more than two contact beams. In certain embodiments, the first and second electrical contacts are substantially aligned such that the body sections and the contact beams of the first and second electrical contacts are aligned along a common contact plane that extends along the mating direction.

DETAILED DESCRIPTION

Embodiments described herein include electrical connectors having a mating side that is configured to engage another connector (hereinafter referred to as a mating connector). The electrical connector includes at least one electrical contact having a plurality of contact beams arranged along the mating side that are configured to engage corresponding contacts of the mating connector. In certain embodiments, the contact beams of one electrical contact have different dimensions, which may include different shapes or geometries. In some cases, the contact beams may be dimensioned differently with respect to one another to effectively reduce or control a mating force that is required to engage the electrical connector and the mating connector. Alternatively, or in addition to reducing the mating force, the contact beams may be dimensioned differently so that the contact beams vibrate or oscillate in different manners (e.g., different frequencies) when the electrical connector is experiencing shock or vibration. In particular embodiments, the contact beams have different lengths with respect to each other and/or have distal ends that have different axial locations with respect to a common reference axis.

In some embodiments, the electrical connectors may be positioned along a leading edge of a circuit board and face in a direction that is parallel to a plane defined by the circuit board. Such electrical connectors may be referred to as right-angle receptacle assemblies or right-angle header assemblies. In other embodiments, the electrical connectors may face away from a board surface such that the electrical connector faces in a direction that is perpendicular to the plane of the circuit board. Such electrical connectors may be referred to as vertical receptacle assemblies or vertical header assemblies. However, the above are merely examples and embodiments set forth herein may be implemented in other assemblies or systems.

Figure 1:
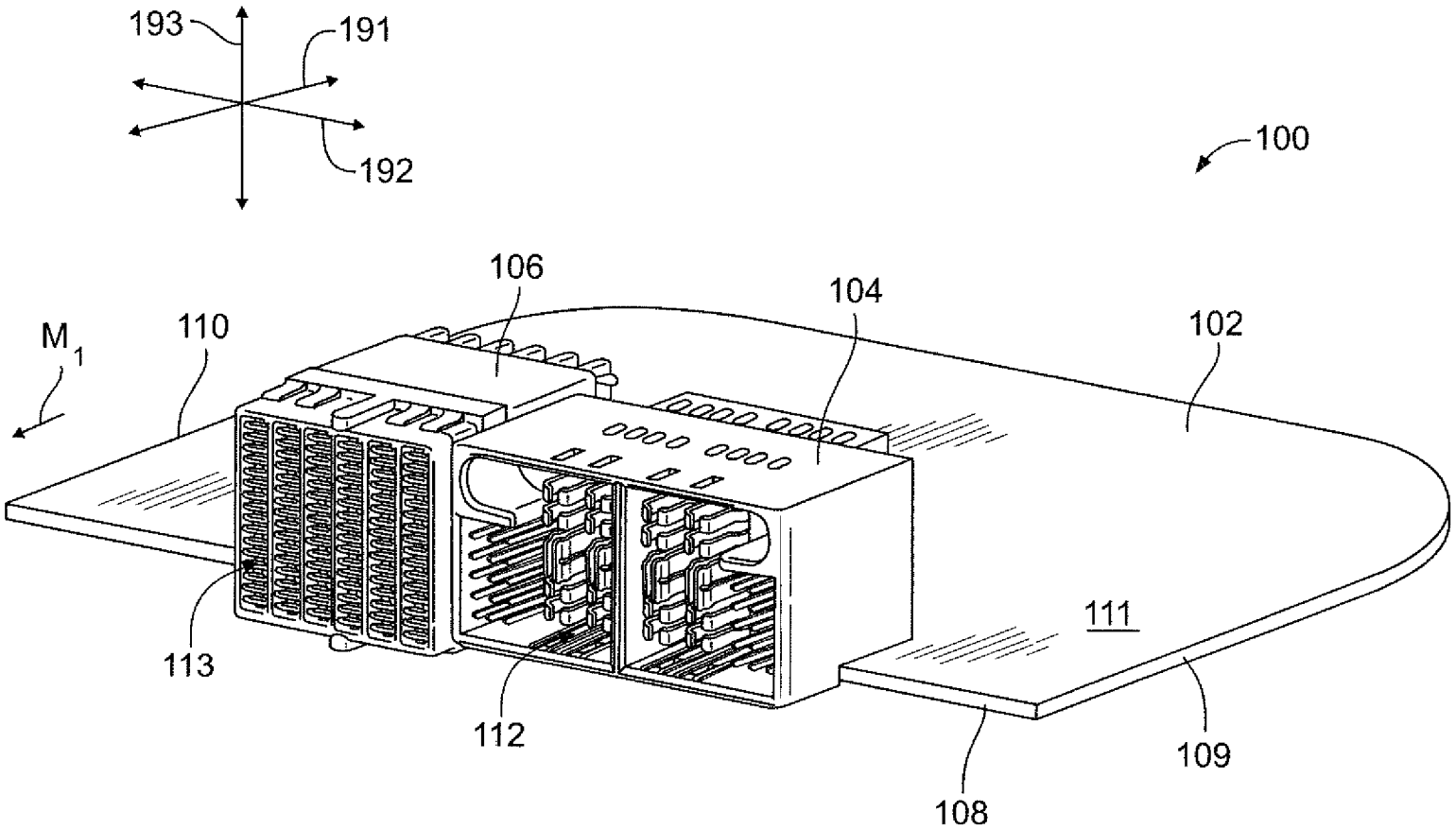
FIG. 1 is a perspective view of a circuit board assembly formed in accordance with one embodiment.

FIG. 1 is a perspective view of a circuit board assembly 100 formed in accordance with one embodiment. As shown, the circuit board assembly 100 is oriented with respect to mutually perpendicular axes 191-193, which include an engagement or mating axis 191, a lateral axis 192, and an orientation or mounting axis 193. The circuit board assembly 100 may include a circuit board 102 and an electrical connector 104 mounted thereto. Optionally, the circuit board assembly 100 may include other components, such as an electrical connector 106 or separate guide mechanisms (not shown) that are directly coupled to the circuit board 102. The circuit board 102 has side edges 109, 110 that extend along the engagement axis 191 and a leading edge 108 that extends between the side edges 109, 110 along the lateral axis 192. The circuit board 102 has a board surface 111 that has the electrical connector 104 and the electrical connector 106 mounted thereto. The electrical connectors 104, 106 are configured to engage (e.g., mate with) corresponding mating connectors.

The circuit board assembly 100 may be used in various applications. By way of example, the circuit board assembly 100 may be used in telecom and computer applications, routers, servers, supercomputers, and uninterruptible power supply (UPS) systems. In one embodiment, the circuit board assembly 100 is part of a backplane system or assembly that includes a backplane circuit board (not shown) that extends orthogonal to the circuit board 102 during operation. In such embodiments, the circuit board assembly 100 may be described as a daughter card assembly. In another embodiment, the circuit board assembly 100 may be configured to mate with a complementary circuit board assembly (not shown) that has a mating connector. The circuit boards may be substantially edge-to-edge after the mating operation and have the connectors extending between the opposing edges. Thus, the two circuit boards may be electrically coupled to each other through the mated electrical connectors. In such embodiments, the electrical connectors may be described as board-to-board or coplanar connectors.

In particular embodiments, the electrical connector 104 may be similar to connectors in the MINIPAK HD power connector product line or the MULTI-BEAM XL/XLE connector product line developed by TE Connectivity that are capable of transmitting electrical power and data. On the other hand, the electrical connector 106 may be exclusively dedicated or primarily dedicated to transmitting data. For example, the electrical connector 106 may be similar to connectors in the STRADA Whisper or Z-PACK TinMan product lines also developed by TE Connectivity. In some embodiments, the electrical connector 106 is capable of transmitting data signals at high speeds, such as 10 Gbps, 20 Gbps, or more.

Although the electrical connector 104 is described and shown as being part of the circuit board assembly 100 in some embodiments, the electrical connector 104 is not required to be configured for mounting to a circuit board. For example, in other embodiments, the electrical connector 104 may be part of an electrical device or a pluggable connector.

As shown in FIG. 1, the electrical connectors 104, 106 have respective mating sides 112, 113 that face in a mating direction $M_1$ along the engagement axis 191. During a mating operation, the mating sides 112, 113 are oriented to face respective mating connectors of another assembly or device. For example, the mating connectors may be mounted on a backplane or other circuit board, bus bar, cable, or any combination thereof. As the electrical connectors 104, 106 engage the corresponding mating connectors, contact beam deflection and frictional forces impede or resist movement of one or more of the connectors. Accordingly, a significant mating force is necessary to overcome the deflection and frictional forces.

Figure 2:
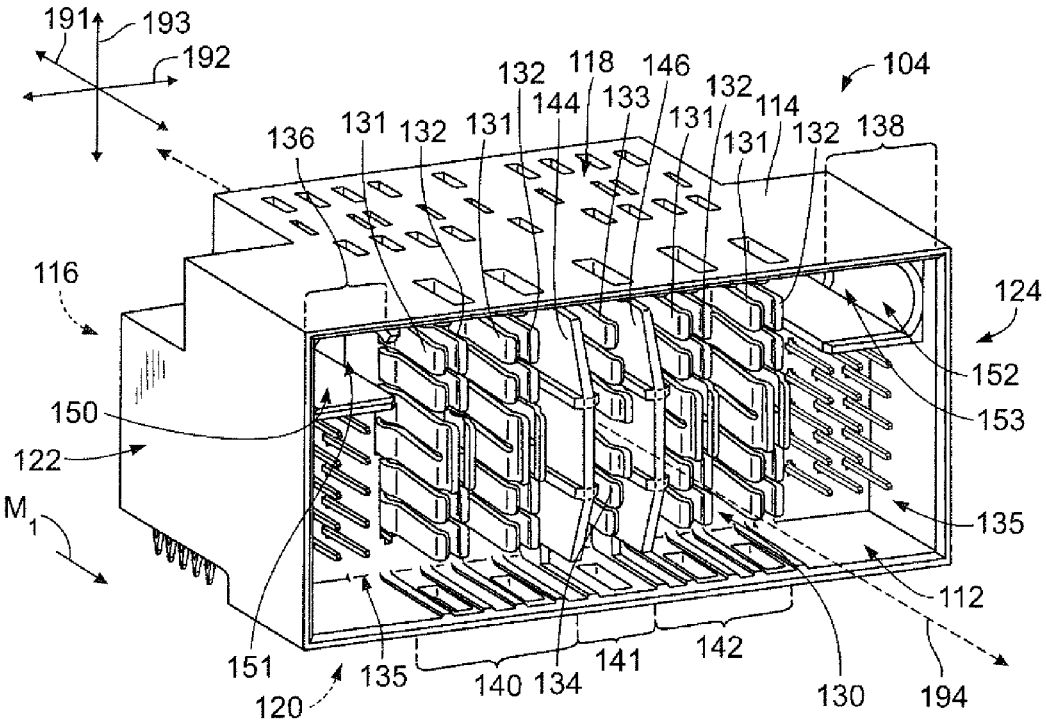
FIG. 2 is an isolated front-perspective view of an electrical connector formed in accordance with one embodiment that may be used with the circuit board assembly of FIG. 1.

FIG. 2 is an isolated perspective view of the electrical connector 104. The electrical connector 104 includes a connector housing 114 that has the mating side 112 and a back side 116. The mating and back sides 112, 116 face in opposite directions along the engagement axis 191. As shown in FIG. 2, a central axis 194 extends between the mating and back sides 112, 116. The central axis 194 extends parallel to the engagement axis 191. The connector housing 114 also includes a top side 118 and a mounting side 120, which face in opposite directions along the orientation axis 193, and first and second end sides 122, 124, which face in opposite directions along the lateral axis 192. The mating and back sides 112, 116, the mounting and top sides 120, 118, and the end sides 122, 124 may represent exterior sides of the connector housing 114. In the illustrated embodiment, the connector housing 114 is generally block-shaped. However, alternative configurations may be used in other embodiments.

As used herein, spatially relative terms, such as "front", "back", "top," "above," "below," and the like, are used herein for ease of description to distinguish one element or feature from another. Such terms are used with reference to the electrical connector 104 having an orientation as shown in FIGS. 1-4 in which the orientation axis 193 extends parallel to the direction of gravity. It will be understood, however, that such spatially relative terms may encompass different orientations of the connector (or its components, such as the electrical contacts) in use or operation. More specifically, if the orientation axis 193 extends parallel to the direction of gravity as shown in FIG. 2, then the top side 118 is above the other sides. However, if the electrical connector 104 as shown in FIG. 2 was turned 90° clockwise about the central axis 194 such that the lateral axis 192 extends parallel to the direction of gravity, then the top side 118 would be lower than the end side 122. Accordingly, the term "top" can encompass both an orientation in which the top side 118 is located above other sides or below at least one side. Likewise, other spatially relative terms are not intended to limit the described embodiment to the orientation shown in FIG. 2 or other figures.

As shown, the connector housing 114 may have a contact cavity 130 that opens to the mating side 112. More specifically, the contact cavity 130 may be accessed through the mating side 112. The electrical connector 104 may include electrical contacts 131-135 that are disposed within the contact cavity 130. In the illustrated embodiment, the electrical contacts 131-134 are dimensioned for transmitting electrical power and, thus, may be referred to as power contacts. The electrical contacts 135 are dimensioned for transmitting data signals and, thus, may be referred to as signal contacts. More specifically, the electrical contacts 131-134 may be sized and shaped to be larger than the electrical contacts 135.

The contact cavity 130 may include a plurality of spatial regions where the electrical contacts 131-135 are located. For example, the contact cavity 130 includes signal regions 136, 138 that are located proximate to the end sides 122, 124, respectively, and power regions 140-142 that are positioned between the signal regions 136, 138. In the illustrated embodiment, the power regions 140, 141 are adjacent to each other and separated by an interior wall 144, and the power regions 141, 142 are adjacent to each other and separated by an interior wall 146. The signal regions 136, 138 include the electrical contacts 135. The electrical contacts 131, 132 are arranged side-by-side in pairs and each of the power regions 140, 142 includes two of the pairs, The power region 141 includes the electrical contacts 133, 134, which are stacked with respect to each other along the orientation axis 193 in the power region 141.

The connector housing 114 may include first and second guide features 150, 152. In the illustrated embodiment, the guide features are guide modules having cavities that extend along the engagement axis 191 and, as such, will hereinafter be referred to as guide modules. The guide modules 150, 152 define cavities 151, 153, respectively, that are sized and shaped to receive and direct a complementary guide projection from the mating connector (not shown). The cavities 151, 153 open to the mating side 112 and also to the contact cavity 130 within the connector housing 114. In alternative embodiments, the first and second guide features 150, 152 may be projections or posts that are shaped to be received by a guide module.

The mating side 112 extends along the lateral axis 192 and the orientation axis 193 and faces in the mating direction $M_1$ along the engagement axis 191. The mating side 112 is configured to engage the mating connector during the mating operation. The mating connector may include features that complement the features of the electrical connector 104. For example, the mating connector may have socket cavities for receiving the electrical contacts 135 and larger cavities for receiving the pairs of electrical contacts 131, 132. During the mating operation, the electrical connector 104 may be moved toward the mating connector and/or the mating connector may be moved toward the electrical connector 104.

Figure 3:
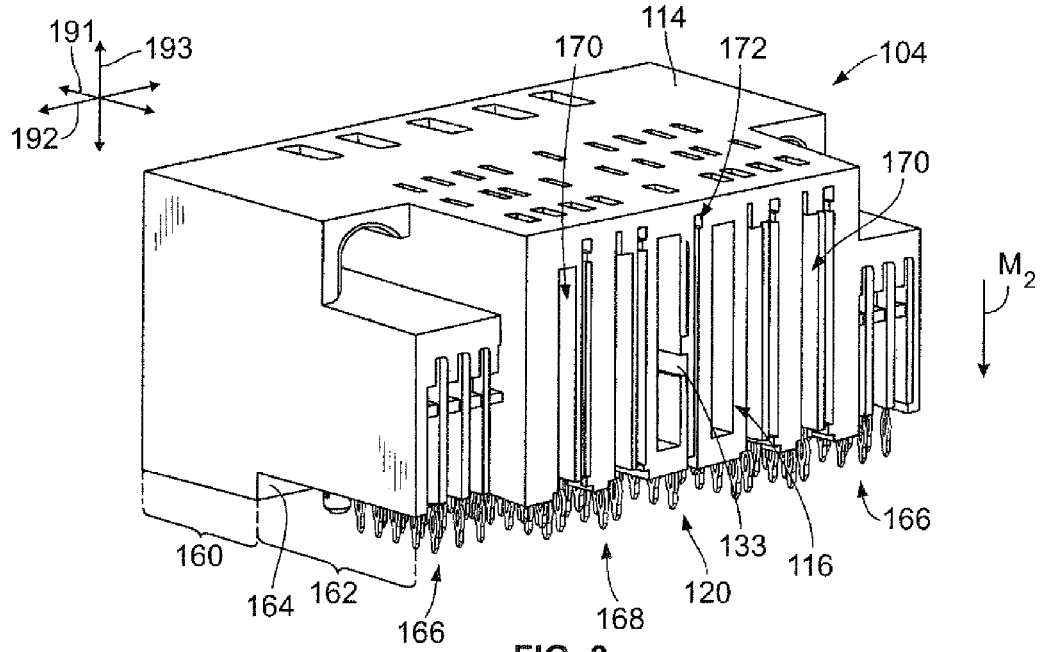
FIG. 3 is an isolated rear-perspective view of the electrical connector of FIG. 2.

FIG. 3 is an isolated rear-perspective view of the electrical connector 104. The mounting side 120 is configured to be mounted along the leading edge 108 (FIG. 1) of the circuit board 102 (FIG. 1). As shown, the mounting side 120 may include an overhang portion 160 and an interface portion 162 that are joined by an edge-facing wall 164. The edge-facing wall 164 extends along the orientation axis 193 and the lateral axis 192 and faces rearwardly toward the back side 116 along the engagement axis 191. In operation, the leading edge 108 is configured to interface with and extend along the edge-facing wall 164. For instance, the leading edge 108 may engage or be located proximate to the edge-facing wall 164. As such, the overhang portion 160 may clear and be located in front of the leading edge 108. The interface portion 162 is configured to be mounted directly onto and interface with the board surface 111 (FIG. 1).

Also shown in FIG. 3, the connector housing 114 may have a plurality of receiving cavities 170, 172 that open to (e.g., are accessible through) the back side 116. Each of the receiving cavities 170 is configured to receive one pair of the electrical contacts 131, 132. The receiving cavity 172 is configured to receive each of the electrical contacts 133, 134. As shown, the electrical contacts 131, 132 may be positioned adjacent to each other with a remainder of the receiving cavity 170 extending therebetween. The electrical contacts 133, 134 may be stacked over each other along the orientation axis 193.

The electrical connector 104 may have a plurality of contact tails 166, 168 that project from the interface portion 162 in a mounting direction $M_2$ along the orientation axis 193. The contact tails 166 are extensions of the electrical contacts 135 (FIG. 2). The contact tails 168 are extensions of the electrical contact 131-133 and the electrical contact 134 (FIG. 2). The contact tails 166, 168 may have compliant or press-fit structures that are configured to engage and be deformed by corresponding plated thru-holes (PTHs) (not shown) of the circuit board 102. As such, the contact tails 166, 168 may mechanically and electrically engage the corresponding PTHs. The contact tails 166, 168 may remain electrically engaged to the PTHs during operation through a frictional engagement (e.g., interference fit). Alternatively, the contact tails can be designed for solder applications.

Figure 4:
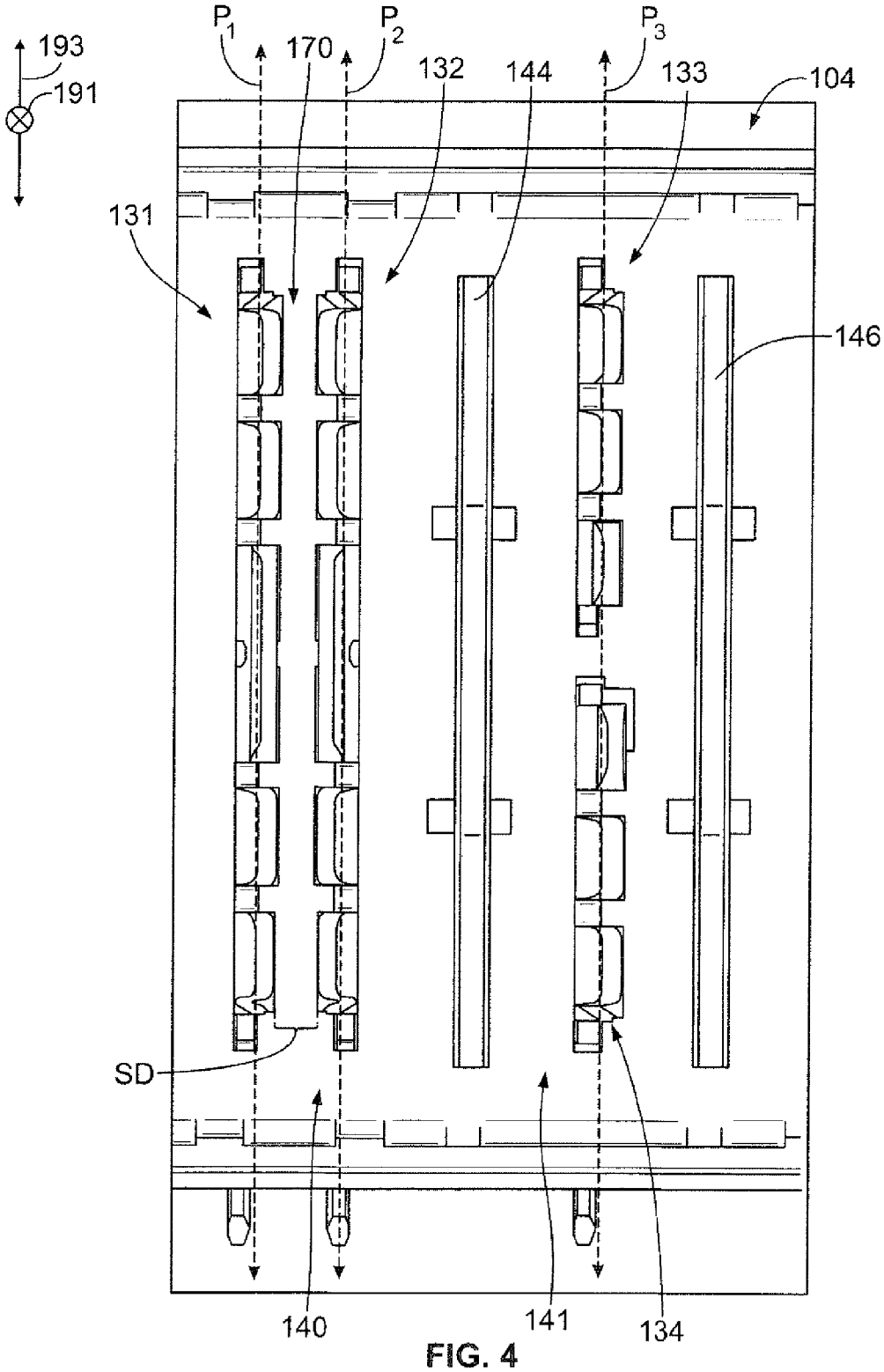
FIG. 4 is an enlarged front-end view of a portion of the electrical connector of FIG. 2.

FIG. 4 is an enlarged front-end view of a portion of the electrical connector 104. In particular, FIG. 4 shows one pair of electrical contacts 131, 132 from the power region 140 and the electrical contacts 133, 134 from the power region 141. The power region 141 is defined between the interior walls 144, 146, and the power regions 140, 141 are separated from each other by the interior wall 144.

As shown, the electrical contact 131 substantially resides in a contact plane $P_1$, the electrical contact 132 substantially resides in a contact plane $P_2$, and the electrical contacts 133, 134 substantially reside within a contact plane $P_3$. In the illustrated embodiment, the contact planes $P_1$-$P_3$ extend parallel to a plane defined by the engagement axis 191 and the orientation axis 193.

The electrical contacts 131, 132 are each disposed within the receiving cavity 170 and have a separation distance SD therebetween. In particular embodiments, the electrical contacts 131, 132 are plural parts of a single conductive pathway such that electrical power may flow through multiple parallel paths in the same direction. Each of the electrical contacts 131, 132 is configured to engage one or more corresponding contacts of the mating connector (not shown), such as the busbar 280 shown in FIG. 8.

Figure 5:
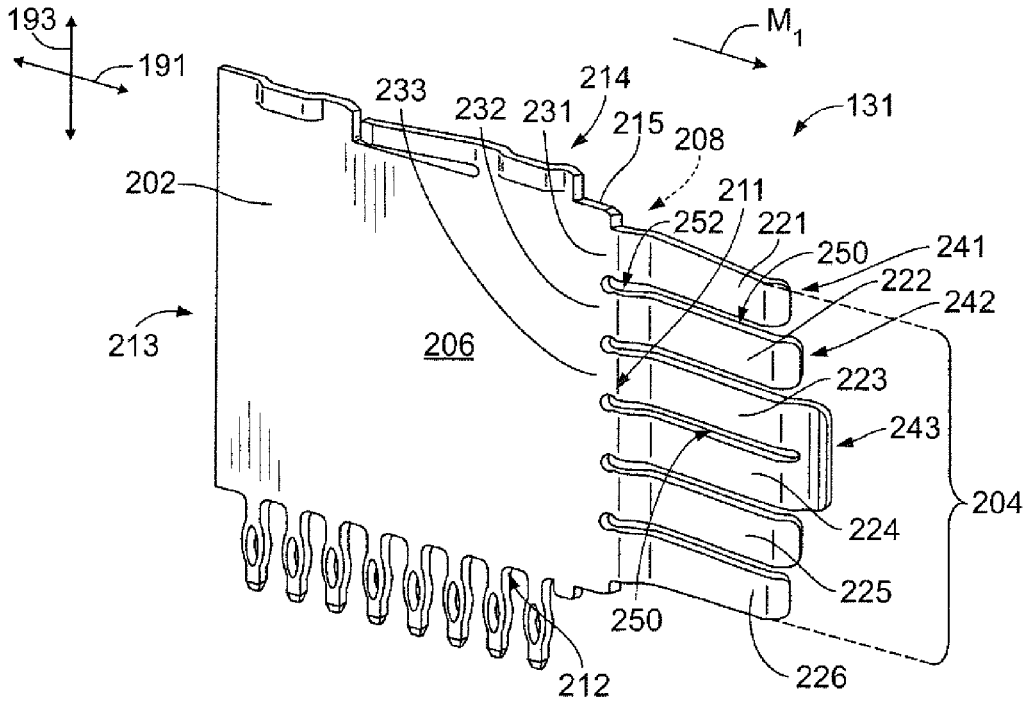
FIG. 5 is an isolated perspective view of an electrical contact formed in accordance with one embodiment that may be used with the electrical connector of FIG. 2.
Figure 6:
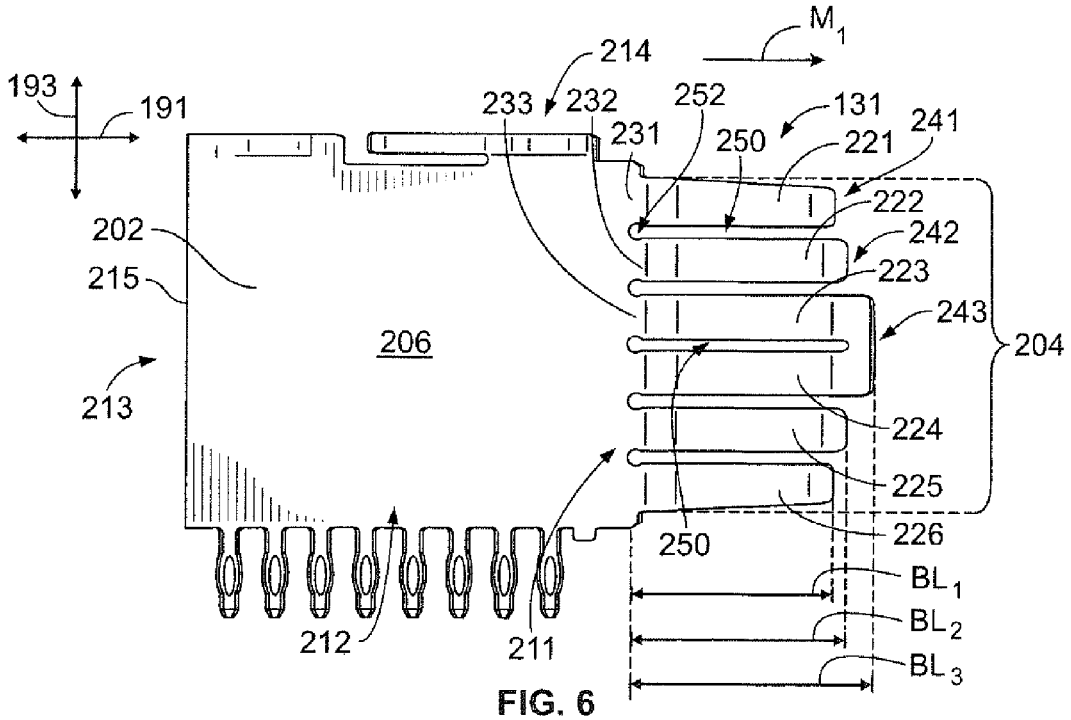
FIG. 6 is an isolated side view of the electrical contact of FIG. 5.

FIGS. 5 and 6 show isolated perspective and side views, respectively, of the electrical contact 131. Although the following description is with respect to the electrical contact 131, the electrical contact 132 (FIG. 2) may be formed in a similar manner. As shown, the electrical contact 131 includes a common body section 202 and a plurality of contact beams 204 that extend from the body section 202 in the mating direction $M_1$. In the illustrated embodiment, the contact beams 204 extend parallel to each other along the engagement axis 191. Each of the contact beams 204 is configured to engage a contact of the mating connector to establish an electrical connection, such as the busbar 280 shown in FIG. 8. The body section 202 may be a planar body that resides in the contact plane $P_1$ (FIG. 4). The body section 202 may be substantially orthogonal to the circuit board 102 (FIG. 1) when the electrical connector 104 is mounted thereto.

The electrical contact 131 may be stamped and formed from conductive sheet material (e.g., metal) to form the body section 202 and the contact beams 204. More specifically, the electrical contact 131 may be a single piece of metal, such as a copper alloy. Accordingly, a shape of the electrical contact 131 may be defined by the stamped edges that are created from the stamp-and-form process. As shown, the electrical contact 131 includes a first side surface 206 and a second side surface 208 (FIG. 5) that face in opposite directions and define a thickness of the electrical contact 131 therebetween. The body section 202 includes a leading edge portion 211, a loading edge portion 212, a rear edge portion 213, and a body-engaging edge portion 214.

In the illustrated embodiment, a single stamped edge 215 extends continuously around a perimeter of the electrical contact 131 to substantially form the edge portions 211-214. The stamped edge 215 may also form the contact beams 204 that project from the leading edge portion 211. As shown, the loading and body-engaging edge portions 212, 214 are opposite each other, and the leading and side edge portions 211, 213 are opposite each other. However, in other embodiments, the edge portions 211-214 may have different configurations. For example, the leading edge portion and the loading edge portion may be opposite each other. The contact beams 204 extend in a common direction (i.e., the mating direction $M_1$) along the engagement axis 191.

Embodiments set forth herein may include an electrical contact that has multiple contact beams extending from a common body section (i.e., the same body section) in which at least some of the contact beams have different dimensions and/or have distal ends with different axial locations with respect to a reference axis. For example, the contact beams 204 include a first contact beam 221, a second contact beam 222, and a third contact beam 223. The contact beams 221-223 have contact bases 231-233, respectively, that are each coupled to the body section 202. Each of the contact beams 221-223 extends to a respective distal end 241-243 from the respective contact base 231-233. In the illustrated embodiment, the contact bases 231-233 extend directly from the leading edge portion 211. As shown, a spacing or gap 250 may separate adjacent contact beams 204 and a notch portion 252 of the spacing 250 may separate adjacent contact bases. In some embodiments, the contact bases 231-233 are aligned with respect to each other along the orientation axis 193 as shown in FIGS. 5 and 6 such that each contact beam 204 begins from a common axial location (i.e., the same axial location) with respect to the engagement axis 191.

Although the contact beams 204 may have different dimensions, in some embodiments, the contact beams 204 may also include two or more contact beams 204 that have the same dimensions. For example, the electrical contact 131 also includes a fourth contact beam 224, which may generally have the same dimensions as the third contact beam 223; a fifth contact beam 225, which may have the same dimensions as the second contact beam 222; and a sixth contact beam 226, which may have the same dimensions as the first contact beam 221. As such, the fourth contact beam 224 may be referred to as another third contact beam, the fifth contact beam 225 may be referred to as another second contact beam, and the sixth contact beam 226 may be referred to as another first contact beam.

As shown, the contact beams 223, 224 are joined at and share the distal end 243. In the case of the joined contact beams 223, 224, the spacing 250 is a slot that extends lengthwise along the contact beams 223, 224 between the body section 202 and the distal end 243.

Nevertheless, other embodiments may not have multiple contact beams with the same dimensions. Embodiments may include at least two contact beams in which each contact beam has a different beam length than the other contact beams. For example, each of the electrical contacts 133, 134 (FIG. 9) includes three contact beams in which each contact beam has a different beam length.

With respect to FIG. 6, the contact beams 221-226 have beam lengths that are measured from the respective contact base to the respective distal end. For example, the contact beam 221 has a first beam length $BL_1$ that extends from the contact base 231 to the distal end 241, the contact beam 222 has a second beam length $BL_2$ that extends from the contact base 232 to the distal end 242, and the contact beam 223 has a third beam length $BL_3$ that extends from the contact base 233 to the distal end 243. The contact beams 224-226 may have the beam lengths $BL_3$, $BL_2$, and $BL_1$, respectively. As shown, the beam lengths $BL_1$, $BL_2$, and $BL_3$ are different from one another. More specifically, each of the beam lengths $BL_1$, $BL_2$, and $BL_3$ is not equal to either of the other two beam lengths.

Figure 7:
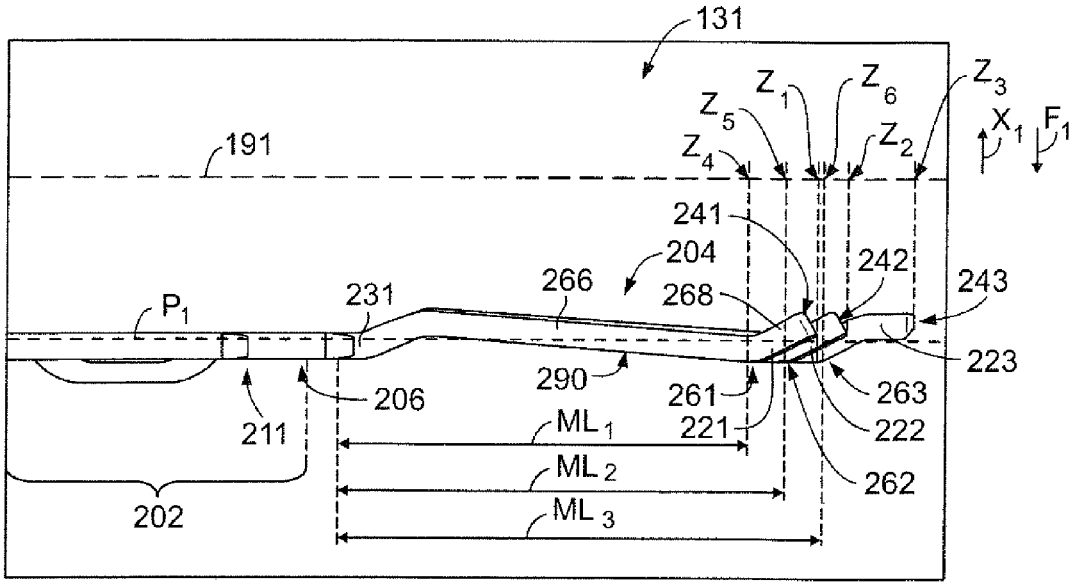
FIG. 7 is a top-down view of a portion of the electrical contact of FIG. 5.

FIG. 7 is a top-down view of a portion of the electrical contact 131 including the body section 202 and the contact beams 204. In particular, FIG. 7 shows the leading edge portion 211 of the body section 202 and the contact beams 221-223 that are projecting from the leading edge portion 211. As shown, the contact plane $P_1$ extends through the electrical contact 131 and parallel to the engagement axis 191. In the illustrated embodiment, the various features of the electrical contact 131 are substantially aligned along the contact plane $P_1$. For example, a majority of each of the contact beams 221-223, the leading edge portion 211, and the body section 202 reside within the contact plane $P_1$. If a portion does not reside within the contact plane $P_1$, that portion extends along and proximate to the contact plane. In other embodiments, one or more features may not reside in the contact plane $P_1$. For example, a majority of each of the contact beams 221-223 may reside in the contact plane $P_1$, but the body section 202 may not reside in the contact plane.

The contact beam 221 may be capable of independently flexing about the respective contact base 231. Likewise, the contact beams 222, 223 may also be capable of independently flexing about the respective contact bases 232, 233 (FIG. 6). In some embodiments, a designated area of the contact beams 221-223 may be configured to directly engage (e.g., directly contact) one or more contacts of the mating connector. As shown, the contact beams 221-223 are shaped to form mating interfaces 261-263, respectively, that are proximate to the respective distal ends 241-243.

In some embodiments, the mating interfaces 261-263 directly engage and slide along a common busbar, such as the busbar 280 (shown in FIG. 8), of the mating connector. In other embodiments, the mating interfaces 261-263 may engage separate busbars or separate contacts. When the mating interfaces 261-263 engage the busbar 280, each of the contact beams 221-223 may be deflected in a lateral direction $X_1$ as indicated and resiliently flex (e.g., bend) about the respective contact base. The contact beams 221-223 are configured such that, when the contact beams 221-223 are engaged to the busbar 280, the contact beams 221-223 provide a resilient force $F_1$ in a direction that is opposite the lateral direction $X_1$. The resilient force $F_1$ facilitates maintaining the electrical connection between the contact beam and the busbar 280 of the mating connector.

In the illustrated embodiment, the mating interfaces 261-263 are the areas of the contact beams 221-223, respectively, that are furthest from the contact plane $P_1$ on one side of the contact plane $P_1$. The mating interfaces 261-263 may be the areas that represent an apex between different segments of the corresponding contact beam. For example, with respect to the contact beam 221, the contact beam 221 has an engagement surface 290 and includes a base segment 266 and an end segment 268. The engagement surface 290 may be a portion of the side surface 206 and extends along each of the base and end segments 266, 268. Each of the base and end segments 266, 268 may extend in a non-orthogonal direction with respect to the contact plane $P_1$. For example, as the contact beam 221 extends from the contact base 231 to the distal end 241, the engagement surface 290 along the base segment 266 extends away from the contact plane $P_1$, and the engagement surface 290 along the end segment 268 extends toward the contact plane $P_1$. As shown, the base segment 266 and the end segment 268 join each other at the mating interface 261 or, in other words, the engagement surface 290 curves and changes direction at the mating interface 261.

The contact beams 221-223 have mating lengths $ML_1$, $ML_2$, and $ML_3$, respectively. The mating lengths $ML_1$, $ML_2$, $ML_3$ represent the distance between the respective contact base 231-233 and the respective mating interface 261-263. As shown in FIG. 7, the mating lengths $ML_1$, $ML_2$, $ML_3$ are different from each other. More specifically, each of the mating lengths $ML_1$, $ML_2$, $ML_3$ is not equal to either of the other two mating lengths.

The distal ends 241-243 and the mating interfaces 261-263 have respective axial locations along the engagement axis 191. In particular, as shown in FIG. 7, the distal ends 241-243 have respective axial locations $Z_1$, $Z_2$, and $Z_3$ which may be different from one another, and the mating interfaces 261-263 have respective axial locations $Z_4$, $Z_5$, and $Z_6$ which may also be different from one another. The respective axial locations $Z_1$, $Z_2$, and $Z_3$ of the distal ends 241-243 determine the beam lengths of the contact beams 221-223, which may be one factor in controlling the vibrations or oscillations of the contact beams 221-223. Additional factors may include the thickness of the contact beam, the width of the contact beam, and the shape of the contact beam, among others. The respective axial locations $Z_4$, $Z_5$, and $Z_6$ of the mating interfaces 261-263 may facilitate staging the engagements of the contact beams 221-223 to the busbar 280.

Figure 8:
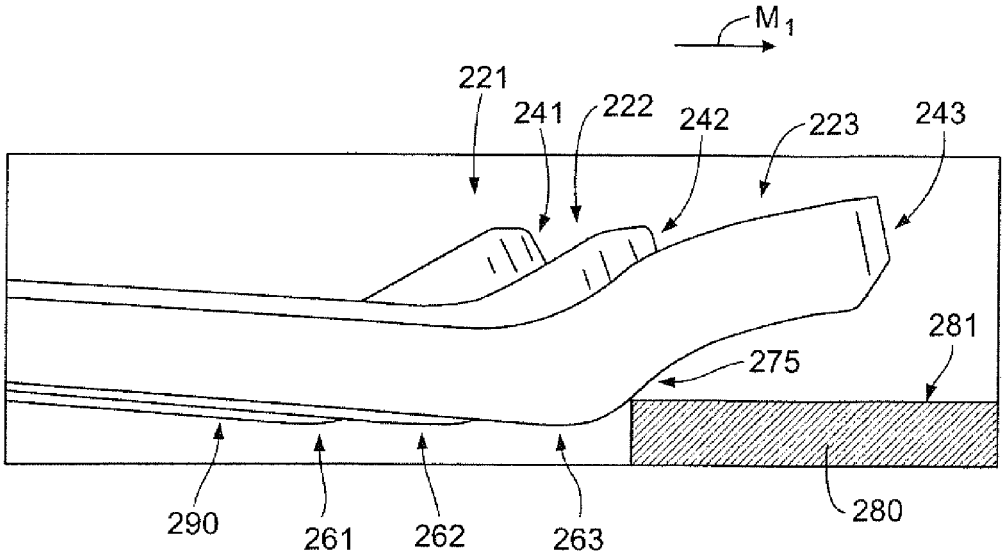
FIG. 8 is an enlarged view of contact beams of the electrical contact of FIG. 5 as one of the contact beams engages another contact from a mating connector.

FIG. 8 is an enlarged view of the contact beams 221-223 proximate to the respective distal ends 241-243. During the mating operation, the mating interfaces 261-263 may engage the busbar 280 according to a predetermined mating sequence in which the mating interfaces 261-263 engage the mating connector at different times. The predetermined mating sequence may be based, in part, on the dimensions of the contact beams 221-223, such as the mating lengths $ML_1$, $ML_2$, $ML_3$ (FIG. 7) and/or the axial locations $Z_4$, $Z_5$, and $Z_6$ (FIG. 7). Compared to other known connectors, such a configuration may reduce the magnitude of the mating force that is necessary to fully mate the electrical connector 104 (FIG. 1) and the mating connector (not shown).

For example, during the mating operation, a busbar 280 of the mating connector may initially engage the contact beam 223 before the busbar 280 engages the contact beams 221 and 222. When the contact beam 223 is initially engaged, the busbar 280 may contact a leading area 275 that is located immediately in front of the mating interface 263 along the engagement surface 290. The leading area 275 may at least partially face in the mating direction $M_1$, whereas the mating interface 263 may face in a direction that is substantially perpendicular or orthogonal to the mating direction $M_1$. The frictional forces created when the leading area 275 initially engages the busbar 280 may be greater than the frictional forces created when the mating interface 263 slides along the busbar 280.

When the contact beam 223 is deflected, the busbar 280 may clear the leading area 275 such that the mating interface 263 slides along an engagement surface 281 of the busbar 280. As the mating interface 263 slides along the busbar 280, the busbar 280 may engage the contact beam 222 in a similar manner as the busbar 280 engaged the contact beam 223. Accordingly, the deflection and frictional forces that occur when the busbar 280 initially engages the contact beams 221-223 are not generated simultaneously. As such, the magnitude of the mating force may be reduced relative to other known connectors.

In addition to the above, the dimensions of the contact beams 221-223 may cause the contact beams 221-223 to vibrate in different manners when the contact beams 221-223 are exposed to environments that cause such vibrations. When a contact beam vibrates, the contact beam may repeatedly move to and from the corresponding contact (e.g., the busbar) thereby intermittently breaking the electrical connection between the contact beam and the corresponding contact or changing the impedance along the conductive pathway. In contact beams having the same dimensions (e.g., same beam length, mating length, and geometry), the contact beams may vibrate harmonically at a common frequency. Under such circumstances, moments may occur in which each of the contact beams loses its electrical connection with the bus bar at the same time as the other contact beams. Such situations are undesirable.

Embodiments described herein include contact beams having different beam lengths, different mating lengths, and/or other structural differences that may cause the contact beams to vibrate at different frequencies. As such, the likelihood that the contact beams will simultaneously lose their respective electrical connections is reduced. For example, at least one contact beam may be electrically connected to the busbar when at least one other contact beam is not.

Figure 9:
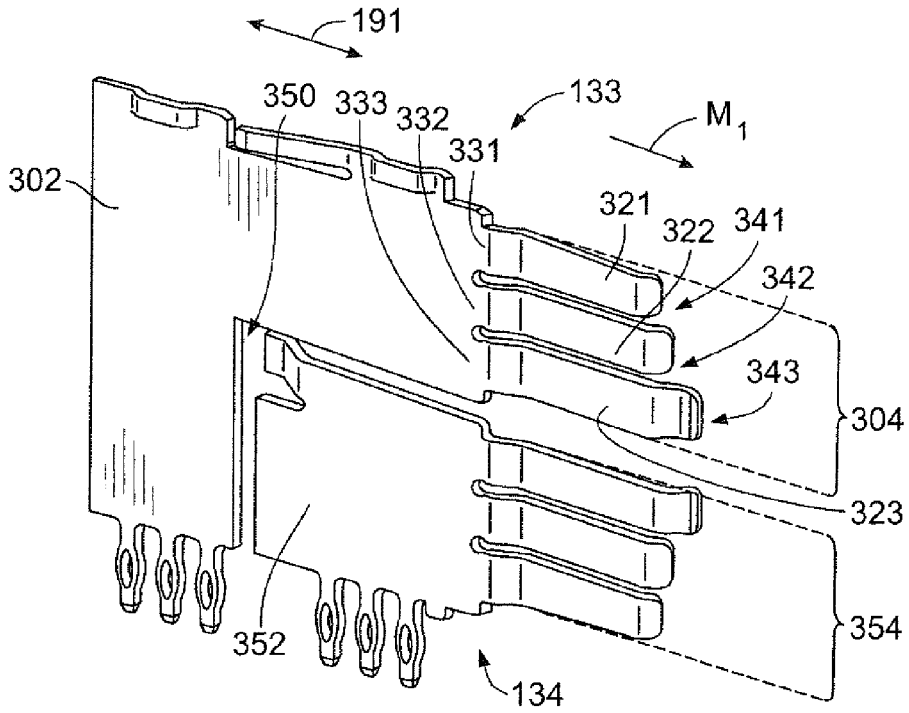
FIG. 9 is an isolated perspective view of electrical contacts formed in accordance with one embodiment that may be used with the electrical connector of FIG. 2.
Figure 10:
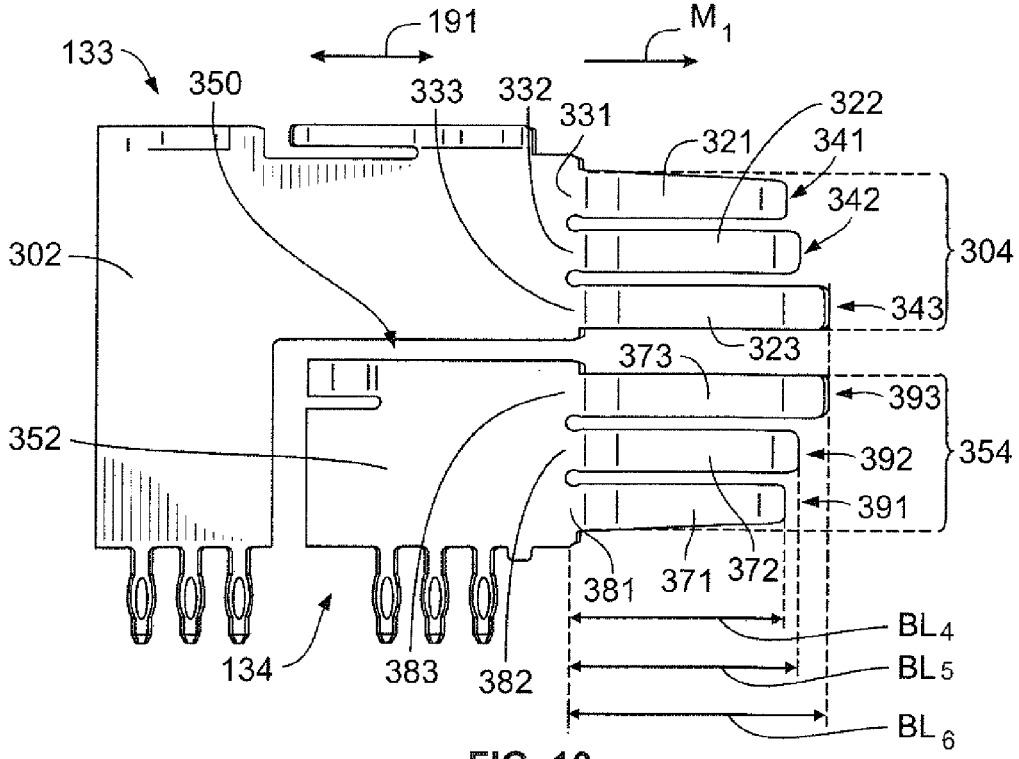
FIG. 10 is an isolated side view of the electrical contacts of FIG. 9.

FIG. 9 shows an isolated perspective view of the electrical contacts 133, 134, and FIG. 10 shows an isolated side view of the electrical contacts 133, 134. As shown, the electrical contact 133 includes a common body section 302 and a plurality of contact beams 304 that extend from the body section 302 in a common direction (e.g., the mating direction $M_1$). Likewise, the electrical contact 134 includes a common body section 352 and a plurality of contact beams 354 that extend from the body section 352 in a common direction, which may also be the mating direction $M_1$. The body sections 302, 352 may be planar and may be substantially aligned with each other along the contact plane $P_3$ (FIG. 4). The body sections 302, 352 may extend substantially orthogonal to the circuit board 102 (FIG. 1) when the electrical connector 104 is mounted thereto.

Similar to the electrical contact 131 (FIG. 2), the electrical contacts 133, 134 may be stamped and formed from conductive sheet material (e.g., metal) to form the body sections 302, 352, respectively, and the contact beams 304, 354, respectively. Although not referenced specifically, the electrical contacts 133, 134 may have other features that are similar or identical to the features of the electrical contact 131. As shown by comparing FIGS. 6 and 10, the electrical contact 131 may have a similar profile as the electrical contacts 133, 134 combined. However, the electrical contacts 133, 134 are independent members separated along a contact spacing 350. As such, each of the electrical contacts 133, 134 may be configured to transmit about half of the electrical power that the electrical contact 131 transmits.

Each of the contact beams 304 is configured to engage a busbar (not shown) of the mating connector, and each of the contact beams 354 may be configured to engage a different busbar (not shown) of the mating connector. In an exemplary embodiment, the electrical contacts 133, 134 are oriented to be substantially aligned along the contact plane $P_3$ (FIG. 4) such that the contact beams 304, 354 and the body sections 302, 352 substantially reside in the contact plane $P_3$.

The contact beams 304, 354 may have similar dimensions as the contact beams 204 (FIG. 5), and at least some of the contact beams 304, 354 have different dimensions and/or have distal ends with different axial locations. For example, the contact beams 304 include a first contact beam 321, a second contact beams 322, and a third contact beam 323. The contact beams 321-323 have contact bases 331-333, respectively, that are each coupled to the body section 302 and extend to respective distal ends 341-343.

The contact beams 354 include a first contact beam 371, a second contact beam 372, and a third contact beam 373. Each of the contact beams 371-373 has a respective contact base 381-383 that is coupled to the body section 352 and extends to a respective distal end 391-393. In some embodiments, the contact bases 331-333 and 381-383 are aligned with respect to each other as shown in FIGS. 9 and 10 such that each of the contact beams 304, 354 begins from a common axial location with respect to the engagement axis 191.

The dimensions of the contact beams 304, 354 may be similar to the contact beams 204 and, in some embodiments, identical. For example, with respect to FIG. 10, the contact beams 321-323 and 371-373 have beam lengths that are measured from the respective contact base to the respective distal end. The first contact beams 321, 371 have a beam length $BL_4$ that extends from the contact bases 331, 381, respectively, to the distal ends 341, 391, respectively. The second contact beams 322, 372 have a beam length $BL_5$ that extends from the contact bases 332, 382, respectively, to the distal ends 342, 392, respectively. The third contact beams 323, 373 have a beam length $BL_6$ that extends from the contact bases 333, 383, respectively, to the distal ends 343, 393, respectively.

In the illustrated embodiment, the beam lengths $BL_4$-$BL_6$ are identical to the beam lengths $BL_1$-$BL_3$, respectively. Moreover, the contact beams 321-323 and 371-373 may have mating lengths that are identical to the mating lengths of the contact beams 204 (FIG. 5) of the electrical contact 131. More specifically, the contact beams 321, 371 may have the mating length $ML_1$ (FIG. 7); the contact beams 322, 372 may have the mating length $ML_2$ (FIG. 7); and the contact beams 323, 373 may have the mating length $ML_3$ (FIG. 7). As such, the contact beams 304, 354 may operate in a similar manner as the contact beams 204 with respect to the predetermined mating sequence. The vibrational characteristics may also be similar, but it should be noted that the separate body sections 302, 352 may cause differences in how the contact beams 304, 354 vibrate.

Figure 11:
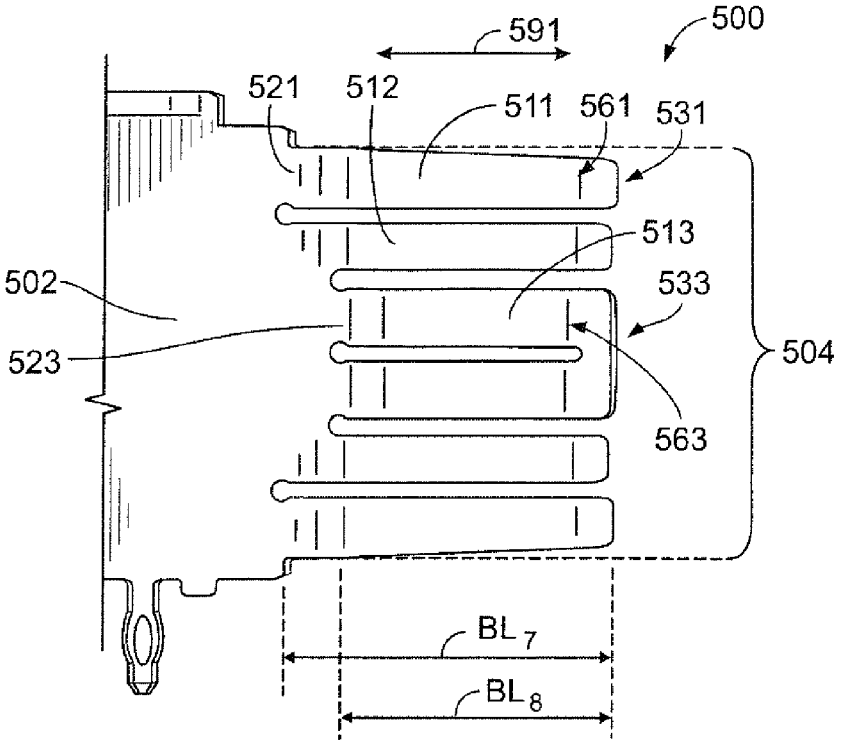
FIG. 11 is an isolated side view of an electrical contact formed in accordance with one embodiment.

FIG. 11 is a side view of a portion of an electrical contact 500, which illustrates an embodiment in which the axial locations of the distal ends (and mating lengths) for two of the contact beams may be the same, but the beam lengths may be different. Such embodiments may be suitable for applications in which staging the contact engagements is not desired, but maintaining electrical connection when the contact beams are vibrating is desired. As shown, the electrical contact 500 includes a body section 502 and a plurality of contact beams 504. More specifically, the plurality of contact beams 504 includes a first contact beam 511, a second contact beam 512, and third contact beam 513. The contact beams 511, 513 have respective distal ends 531, 533 that are located at a common axial location with respect to an engagement axis 591. However, each of the contact beams 511, 513 extends from a contact base 521, 523, respectively. The contact bases 521, 523 do not have a common axial location such that a beam length $BL_7$ of the contact beam 511 is not equal to a beam length $BL_8$ of the contact beam 513. Nevertheless, the contact beams 511, 513 may have mating interfaces 561, 563 that have a common axial location with respect to the engagement axis 591.

Figure 12:
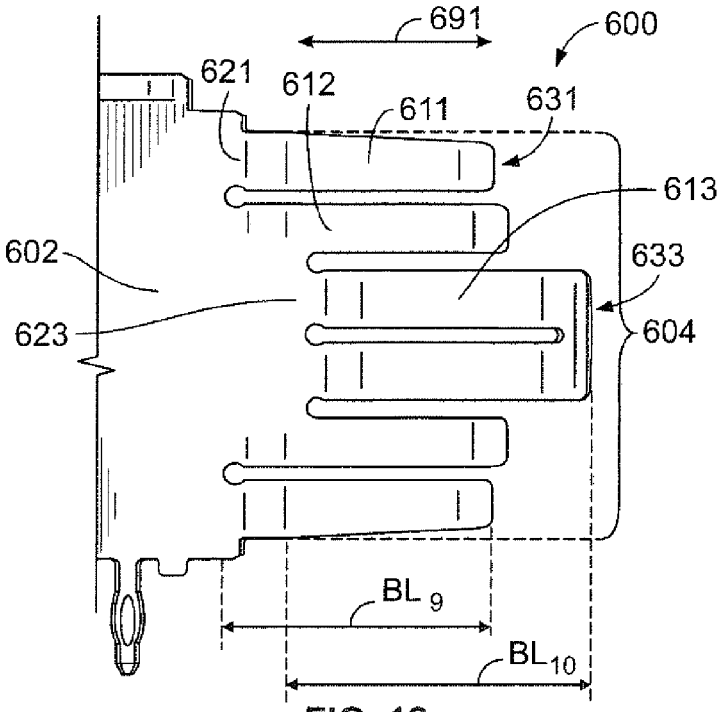
FIG. 12 is an isolated side view of an electrical contact formed in accordance with one embodiment.

FIG. 12 is a side view of a portion of an electrical contact 600, which illustrates an embodiment in which the beam lengths for two of the contact beams are the same, but the axial locations of the distal ends and the mating interfaces are different. Such embodiments may be suitable for applications in which staging the contact engagements is desired, but the environment does not typically include vibrations that cause the contact beams to lose their respective electrical connections. As shown, the electrical contact 600 includes a body section 602 and a plurality of contact beams 604. The plurality of contact beams 604 includes a first contact beam 611, a second contact beam 612, and third contact beam 613. The contact beams 611, 613 extend from respective contact bases 621, 623 to respective distal ends 631, 633. As shown, the distal ends 631, 633 have different axial locations with respect to an engagement axis 691. Also shown, the contact beams 611 and 613 have beam lengths $BL_9$, $BL_{10}$, respectively. In the illustrated embodiment, the beam lengths $BL_9$, $BL_{10}$ are equal.

As used herein, an element or step recited in the singular and proceeded with the word "a" or "an" should be understood as not excluding plural of said elements or steps, unless such exclusion is explicitly stated. Furthermore, references to "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. In addition, in the following claims, the term "plurality" does not include each and every element that an object may have. For example, if the claims recite an electrical contact having "a plurality of contact beams," the plurality of contact beams may not include each and every contact beam that the electrical contact may have. There may be additional contact beams that do not have the features recited in the claims with respect to the plurality. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a connector housing having a mating side that faces in a mating direction, the mating side configured to engage a mating connector; and an electrical contact held by the connector housing, the electrical contact including a common body section and first, second, and third contact beams that are arranged along the mating side and have respective contact bases coupled to the body section, each of the first, second, and third contact beams extending in the mating direction from the respective contact base to a respective distal end, wherein each of the first, second, and third contact beams has a beam length that is measured from the respective contact base to the respective distal end, the beam lengths of the first, second, and third contact beams being different from one another, wherein the electrical contact is a first electrical contact and the electrical connector further comprises a second electrical contact that includes a common body section and fourth and fifth contact beams, each of the fourth and fifth contact beams extending in the mating direction from a respective contact base that is coupled to the body section of the second electrical contact to a respective distal end, the fourth and fifth contact beams having beam lengths, respectively, that are measured from the respective contact base to the respective distal end, wherein the beam lengths of the fourth and fifth contact beams are different from each other.

2. The electrical connector of claim 1, wherein the first, second, and third contact beams and the body section of the first electrical contact are substantially aligned along a common contact plane that extends along the mating direction.

3. The electrical connector of claim 1, wherein each of the first, second, and third contact beams is shaped to form a respective mating interface proximate to the respective distal end, the mating interfaces are configured to directly engage the mating connector, the first, second, and third contact beams having first, second, and third mating lengths, respectively, that are measured from the respective contact base to the respective mating interface, wherein the first, second, and third mating lengths are different from one another.

4. The electrical connector of claim 1, wherein the body section of the first electrical contact is substantially planar and the connector housing includes a mounting side that is configured to engage a circuit board, the body section of the first electrical contact being orthogonal to the circuit board when the electrical connector is mounted thereto.

5. The electrical connector of claim 1, wherein the body sections of the first and second electrical contacts are substantially planar and either extend parallel to each other or are aligned along a common contact plane.

6. The electrical connector of claim 1, wherein the respective distal ends of the first, second, and third contact beams have different axial locations with respect to an engagement axis that extends along the mating direction.

7. The electrical connector of claim 1, wherein each of the first, second, and third contact beams is capable of independently flexing about the respective contact base.

8. The electrical connector of claim 1, wherein the first contact beam is adjacent to the second contact beam and the third contact beam is adjacent to at least one of the first contact beam or the second contact beam.

9. The electrical connector of claim 1, wherein the electrical contact includes a plurality of at least one of the first contact beam, the second contact beam, or the third contact beam.

10. An electrical connector comprising:

a connector housing having a mating side that faces in a mating direction along an engagement axis, the mating side configured to engage a mating connector;

an electrical contact held by the connector housing, the electrical contact including a common body section and first, second, and third contact beams that are arranged along the mating side and configured to engage the mating connector, each of the first, second, and third contact beams extending parallel to the engagement axis from a respective contact base that is coupled to the body section to a respective distal end, wherein the distal ends of the first, second, and third contact beams have different axial locations with respect to the engagement axis, wherein the electrical contact is a first electrical contact and the electrical connector further comprises a second electrical contact that includes a common body section and fourth and fifth contact beams each of the fourth and fifth contact beams having a respective contact base coupled to the body section and extending in the mating direction from the respective contact base to a respective distal end, wherein the distal ends of the fourth and fifth contact beams have different axial locations with respect to the engagement axis.

11. The electrical connector of claim 10, wherein the first, second, and third contact beams and the body section are substantially aligned along a common contact plane that extends parallel to the engagement axis.

12. The electrical connector of claim 10, wherein the first contact beam is adjacent to the second contact beam and the third contact beam is adjacent to at least one of the first contact beam or the second contact beam.

13. The electrical connector of claim 10, wherein the first, second, and third contact beams have first, second, and third beam lengths, respectively, that are measured from the respective contact base to the respective distal end, the first, second, and third beam lengths being different from one another.

14. The electrical connector of claim 10, wherein each of the first, second, and third contact beams is shaped to form a respective mating interface that directly engages the mating connector, the first, second, and third contact beams having first, second, and third mating lengths, respectively, that are measured from the respective contact base to the respective mating interface, the first, second, and third mating lengths being different from one another, wherein each of the first, second, and third contact beams is capable of independently flexing about the respective contact base.

* * * * *